United States Patent [19]

Ibsen

[11] Patent Number: 5,054,538

[45] Date of Patent: Oct. 8, 1991

[54] AUTOMATIC FOUNDRY PLANT

[75] Inventor: Peter Ibsen, Charlottenlund, Denmark

[73] Assignee: Dansk Industri Syndikat A/S, Denmark

[21] Appl. No.: 525,707

[22] Filed: May 21, 1990

[30] Foreign Application Priority Data

May 19, 1989 [DK] Denmark ..... 2454/89

[51] Int. Cl.[5] ..... B22P 25/00

[52] U.S. Cl. ..... 164/154; 164/5; 164/269; 164/323

[58] Field of Search ..... 164/456, 457, 458, 5, 164/150, 154, 155, 412, 167, 269, 323

[56] References Cited

U.S. PATENT DOCUMENTS 4,915,160 4/1990 Reynolds ..... 164/154

FOREIGN PATENT DOCUMENTS 61-37347 2/1986 Japan ..... 164/5

7707988 1/1979 Netherlands ..... 164/5

*Primary Examiner*—Kuang Y. Lin

*Attorney, Agent, or Firm*—Larson & Taylor

[57] ABSTRACT

In an automatic foundry plant of the kind in which at an extraction station (41) water is dosed in (at 42) in order to maintain the correct moisture content in the molding sand, which is returned to the molding station (11), and in which new molding sand (at 43), new binder (at 44), and/or new additive (at 45) may be added in a sand treatment station (46), the new feature consists in that the dosing of water and possibly of the other agents mentioned is controlled by means of an automatic control system (51–53) in dependence of information collected upstream of the extraction station regarding the condition of the individual molds arriving at the extraction station, especially with regard to whether metal has been poured in them or not, a very important factor for the moisture content, because this is greatly reduced by the hot metal poured.

9 Claims, 1 Drawing Sheet

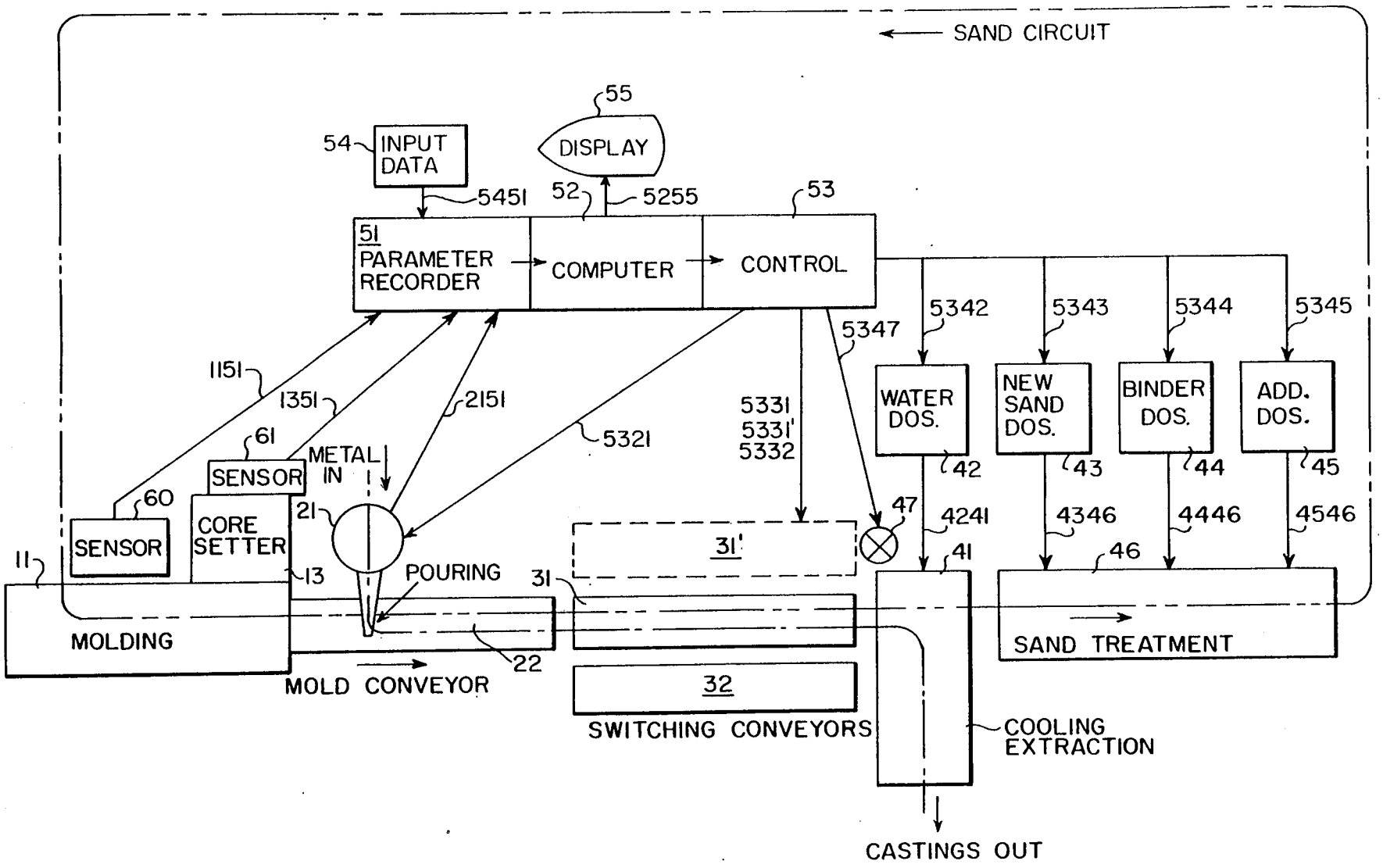
SAND CIRCUIT
ADD. DOS.
BINDER DOS.
NEW SAND DOS.
WATER DOS.
SAND TREATMENT
COOLING EXTRACTION
CASTINGS OUT
CONTROL
COMPUTER
PARAMETER RECORDER
DISPLAY
INPUT DATA
SWITCHING CONVEYORS
POURING
MOLD CONVEYOR
METAL IN
SENSOR
CORE SETTER
MOLDING
5345
5344
5343
5342
5347
5331
5331'
5332
5321
5255
5451
2151
1351
1151
4546
4446
4346
4241
45
44
43
42
41
46
47
53
52
55
54
51
31'
32
31
22
21
13
61
60
11

AUTOMATIC FOUNDRY PLANT

The present invention relates to an automatic foundary plant of the kind disclosed in more detail below and also set forth in claim 1.

In such plants it is very important that the used mold material liberated in the casting extractor station and returned to the mold-making and mold-preparation station has the right degree of moisture and possibly the correct content of binder and other additives with a view to rendering the molds made from this material in the moldmaking and preparation station as well suited for casting as possible. As is known, it is partly a matter of giving the mold section the required firmness for withstanding the pouring with molten metal, in which procedure the correct water content and binder content is essential, and partly of the mold section containing additives, which produce certain desirable properties in the surface of the finished castings, when the surfaces of the mold cavity coming into contact with the molten metal pouring in, and/or facilitate the subsequent extraction. It is also very important that in the extraction station there should be sufficient moisture to prevent the formation of dust during the extraction process, which normally includes crushing the mold sections. The purpose of the water-dosing stations attached to the extraction station is therefore to ensure the moisture content required for this purpose. At the same time, however, it must be ensured that excessive moisture is not added in the extraction station, because the mold material returned to the mold-making and preparation station for the purpose of making new molds would be too moist for making the mold section sufficiently firm.

For various reasons it happens during the operation of such a system that a few of the molds are not poured. This may be due to either defective molds, or that pouring must be omitted in those molds that in certain cases may happen to be in the transition zone between two sequentially adjacent conveyors on the stretch between the pouring station and the extraction station. The consequence of this is that the moisture content in the molds that have not be poured will be considerably higher than in the remaining molds, where the heat from the molten metal causes evaporation of a considerable part of the moisture.

On this background it is the object of the present invention to provide a plant of the kind referred to initially, in which the content of moisture and possibly also of additives of various kinds can automatically be kept within the limits allowing production of molds with optimum firmness and optimum qualities otherwise as mentioned above, and this object is achieved with a plant which, according to the invention, is adapted and constructed as set forth in claim 1. This arrangement enables the system to gather information to signify at which of the molds passing there has been a consumption of water, or possibly of additives, the plant using this information for controlling the dosing of water and possibly of the other additives mentioned. Suitable embodiments of the plant are set forth in claims 2–5, and the effect of these embodiments is explained in the following detailed portion of the present specification. At this stage it should be mentioned, however, that with the embodiment set forth in claim 5 it is possible to use modern data processing technology, which partly makes it very easy to store the information concerning the individual mold until the time when it is to be used for generating a control signal for the dosing in question, and partly enabling the selection and adjustment of the various functions by a simple change of a program, instead of as in the case of the conventional wiring, relays, etc. to adjust a large number of circuit components, control units, etc.

The invention will be explained in the following with reference to the drawing, which is a block diagram of an exemplary embodiment of an automatic foundry plant according to the present invention such as the plant may be envisaged in casting objects of iron or iron alloys in molds of molding sand produced before the individual casting runs, and then being crushed for the purpose of re-use of the molding sand.

The exemplary embodiment of an automatic foundry plant according to the invention shown in the drawing has been drawn as highly simplified as possible in order to facilitate the understanding of the control processes involved in the present invention.

This part of the plant includes a molding station 11, in which suitable mold material, such as molding sand, is molded into mold sections. These mold sections are delivered from the molding station 11 to a mold conveyor 22. A core setter 13 is used to place cores in the molds made in the molding station 11, before the molds are delivered to the mold conveyor 22. The mold conveyor 22 conveys the molds from the molding station 11 through a pouring station 21. The pouring station 21 provides for pouring of molten metal in a known manner into the mold, which are the moved with their content of poured metal by the mold conveyor 12 onto a set of switching conveyors 31 and 32.

The set of switching conveyors 31 and 32, in addition to being able to convey the molds onwards in the same direction, are also adapted to be switched sideways in such a manner that either the conveyor 31 or the conveyor 32 is placed in alignment with, so as to provide a continuation of, the mold conveyor 22. This is done in order to prolong the duration of the stay of the molds and to thus increase the resulting cooling during the time from the arrival of the molds from the mold conveyor 22 to their delivery to an extraction station 41.

At the extraction station 41 the castings are separated from the molds and any cores, by, for example, being tumbled in a drum, preferably with water dosing in order to bind dust, in order to obtain further cooling and to produce, in addition, a suitable water content in the molding sand produced at extraction.

A sand processing station 46 provides treating of the molding sand for the purpose of re-use in the molding station 11, by, for example adding new molding sand, bentonite, carbon powder and/or other binders and/or additives.

As indicated by the drawing, the finished, cooled and extracted castings are taken out from the extraction station 41 at its end shown lowermost in the drawing. In the drawing the flow of the metal through the pouring station 21, the mold conveyor 22, the switching conveyor 31, and the extraction station 41 is shown by a line with one dot between the dashes, whereas the molding sand flow through the molding station 11, the mold conveyor 22, the switching conveyor 31, the extraction station 41, and the sand treatment station 46 is shown by a line with two dots between the dashes.

In addition to the units mentioned, the plant may comprise a sorting station 47, which is indicated as a "hole in the floor" at the delivery end of the switching conveyor 31, when the latter is in the position 31' shown in broken lines. The sorting station 47 can be used for sorting out molds with or without cast metal in them, which for some reason are not required to be delivered to the extraction station 41.

In addition, the plant shown comprises dosing units for water, new molding sand, binder, etc. in the form of a water dosing unit 42, which is adapted to supply water through a water dosing pipe 4241 to the extraction station 41 (as it will appear from the drawing, the reference numerals for the pipes or lines drawn between the various units have the first two digits identical to the reference numeral of the unit from which the operation or flow concerned originates, whereas the last two digits are identical to the reference numeral of the unit receiving the flow or operation concerned), a new-sand dosing unit 43, which is adapted to supply fresh molding sand through a new-sand pipe 4346 to the sand treatment unit 46, a binder dosing unit 44, which is adapted to supply binder through a binder pipe 4446 to the sand treatment unit 46, and an additive dosing unit 45, which is adapted to supply further additives through an additive pipe 4546 to the sand treatment station 46.

All dosing units 42–45 are adapted to be controlled by a control unit 53, which is adapted to control the functioning of the individual dosing units through the respective control wires 5342-45, as it will be explained below.

The equipment, with which the automatic control functions comprised by this invention are executed, includes, apart from sensors, control converters, and the like not shown in or at the various stations or units, a parameter recording unit 51, computing unit 52, the above-mentioned control unit 53, a data input unit 54, and a data display unit 55.

The units 51–55 can in a manner known in principle be incorporated in a computer with display, keyboard, etc., in which the various functions described here may be more or less integrated in the hardware, or they may be divided in a manner different from the one described here, without producing any in the overall operation.

The parameter recording unit 51 can receive input data in the form of signals from the molding station 11 through a parameter line 1151, the core setter 13 through a parameter line 1351, the pouring station 21 through a parameter line 2151, and from the input data unit 54 through an input data line 5451.

In addition, the parameter recording unit 51 is adapted to emit signals in the form of output data to the computing unit 52.

The computing unit 52 is adapted as indicated above to receive input data signals from the parameter recording unit 51, to emit output data in the form of multiple control signals to the control unit 53, and to emit suitable operator data through a data line 5255 to the data display unit 55.

The control unit 53 is adapted to as mentioned above to receive multiple control signals from the computer unit 52, and to emit control signals as follows:

through a control line 5321 to the pouring station 21, via one or several control lines 5331,5332 and possibly 5331' to the switching conveyors 31 and 32, through a control line 5347 to the sorting station 47, through the control line 5342 to the water dosing unit 42, through the control line 5343 to the new-sand dosing unit 43, through the control line 5344 to the binder dosing unit 44, and through the control line 5345 to the additive dosing unit 45.

The plant can, of course, comprise a number of parameter and/or control lines or wires (not shown) relating to other functions than those dealt with by the present invention.

CONTROL OF POURING STATION

In order to obtain optimum casting in the pouring station 21 it is necessary that the signals used for controlling this station should as a minimum contain data with information about the type of mold at that moment arriving from the molding station 11, whether the core setter 13 has placed the requisite cores in the mold in question.

whether the mold has the requisite firmness to withstand pouring, and whether the mold should be unsuitable for pouring for other reasons than lack of firmness.

By means of sensors 60 and 61 in the molding station 11 and the core setter 13, signals are generated corresponding to the data mentioned, and these signals are transmitted via the parameter lines 1151 and 1351 respectively, to the parameter recording unit 51. The data related to an individual mold are collected in a data record, which by means of suitable circuits and/or programs in the units 51,52 and possibly 53 are made to "follow" the individual molds on their way through the plant from the molding station 11 to the extraction station 41.

The above data, which have been received by the parameter recording 51, are transmitted to the computing unit 52, in which they are transformed into the multiple control signals mentioned above, which are transmitted to the control unit 53, which on the basis of those part-data relating to the control of the pouring station 21, control the function of this station through the control line 5321. This control may comprise for example, that the outlet for molten metal in the pouring station 21 is moved to a position corresponding to the computed position of the inlet (gate) of the mold at that moment placed under the outlet, that if the data in question contain information that a required core has not been set, that the mold does not show the required firmness, and/or that the mold is in some way incomplete, the molten metal outlet in the pouring station 21 is blocked, so that there will not be poured into the mold in question.

The operator may also, if one or several molds bear visible signs of being unsuitable for pouring, block the metal outlet in the pouring station 21 by suitable manual intervention at the input data unit 54.

The individual data records generated at the production and preparation of the individual molds in the molding station 11 and possibly by means of the core setter 13, can suitably be recorded in a register of the FIFO buffer type, in which the whole queue is shifted one step forward each time a new data record is entered, when at various positions along the queue data is read out and/or in from and to the various stations and other controlled units respectively. In this manner the various stations and other controlled units can receive the various data at the exact time when the mold or material in question is placed in or is passing them.

In the parameter recording unit data can be read in, for example via the input data unit 54, with information about for example the metal alloy batch being used at the moment in the pouring station 21. In such case it may contain means (not shown) for providing each mold with a mark corresponding to this information, so that further downstream in the plant it can be ascertained from which batch the casting in question originates. The mark can be made on the mold itself as a visible or machine-readable mark (for example in bar code), but instead of this, or in addition to this, it can be placed in the data record relating to the mold in question with a view to use further downstream in the plant, for example for using the sorting station 47 to reject molds with cast metal that have been made from a batch, which by laboratory tests of a sample taken has proved to be unsuitable for the purpose.

CONTROL OF SWITCH CONVEYORS

In order to allow the molds, in which metal has been poured at the pouring station 21, to cool off sufficiently before they are moved into the extraction station 41, a certain time must pass. However, the speeds at which the molds are conveyed to, through and from the pouring station are so high, that if these molds were to be conveyed in a straight path from the extraction station 41, it would require a conveyor length that may be difficult or impossible to find in an existing foundry hall. In order to reduce the total length of the plant, the conveyor distance from the pouring station 21 to the extractor station 41 has therefore partly been split up into several, and in the case shown two, sidewise switchable conveyors 31 and 32, which have been arranged so that if the conveyor being in line with the mold conveyor 22 has been filled up, it is replaced by the other conveyor and at the same time stopped, the other conveyor being started at the same time. In this way the molds standing on the "shunted-out" switching conveyor will have time to cool off, while new molds are being fed to the other conveyor now placed in line with the mold conveyor 22. When the other conveyor has been filled (or possibly sooner), the conveyors are switched back, so that the cooled molds on the first mentioned conveyor are transferred to the extraction station, and new, hot molds from the mold conveyor are entered after them.

Previously, this switching between the various switching conveyors has been controlled manually or semi-automatically, with the result in practice that pouring must be omitted in a number of molds which at the time of switching are placed near the transition between the mold conveyor 22 and the related switching conveyor 31 or 32. This will obviously involve a not inconsiderable waste of molding sand and - not least - productive time. This problem has been solved by the computing unit 52, on the basis of data relating to the summated dimension of the molds in the direction of travel, deciding a suitable time for the switching conveyors 31 and 32 to move sidewise without any molds being present at the transition location itself. The control required for this takes place via the control unit 53 and the control lines 5331 and 5332 to the switching conveyors 31 and 32.

For several reasons it may be desirable before moving the switching conveyors sideways to create a certain interspace between the mold standing at the output end of the mold conveyor 22 and the mold standing at the input end of the switching conveyor 31 or 32 as the case may be. Especially in cases where the individual molds produced in the molding station 11 are not independent molds, but have each a rearwardly facing mold half matching a forwardly facing mold half on the next mold block for formation of the mold cavity, it is in many cases quite necessary to create an interspace as mentioned. In such cases there is a corresponding control function to make the core setter 13 from omit setting cores, and the pouring station to omit pouring into the mold cavity that is made unsuitable for pouring in this way. All this is, of course, possible by data input and output to and from the data records corresponding to the molds in question when these are situated in positions in the queue corresponding to the stations in question, respectively the transition zone between the mold conveyor 22 and the switching conveyor 31 or 32.

CONTROL OF DOSING UNITS

As mentioned above, the water dosing unit 42 is adapted to be controlled by the control unit 53 to dose a volume of water suitable at any time to the extraction station 41 in order to ensure that the molding sand leaving the extraction station 41 in transit to the sand treatment station 46 and from there back to the molding station 11 has the correct water content. The importance of this is known by foundry specialists. In addition and as mentioned above, the dosing units 43–45 are adapted to be controlled by the control unit 53 to supply fresh molding sand, binder and additives respectively to the sand treatment station 46, in which the constituents now added are mixed with the "old" molding sand, and finally returned to the molding station 11 for the purpose of being re-used for making new molds.

The new molds made in the molding station 11 will therefore, in addition to the original molding sand, contain a certain amount of water and and certain amounts of new molding sand, binder and additives respectively, which are all necessary, partly to replace lost molding sand, partly to make the mold sufficiently firm, and partly to influence the process taking place when the molten metal contacts the walls of the mold cavity, for example for the purpose of influencing the surface of the castings or obtaining good parting or release properties.

The heat imparted to the mold by the poured metal will, of course, cause a certain amount of water to evaporate, while this evaporation will not take place in cases, where for some reason—see above—no metal is poured into the mold cavity in question.

In order to ensure that the amount of water dosed into the extraction unit 41 at any time corresponds as closely as possible to the actual need, the pouring station 21 therefore sends information through the parameter line 2151 of firstly, whether the mould in question has been poured, and secondly, such other parameters as the weight of the mold, the weight and temperature of the poured metal, etc.

This information will then, in a similar manner as described above, be incorporated in the data record associated with the mold in question, when arriving at the place in the "queue" corresponding to the extraction station 41, will suitably instruct the water dosing unit 42. Also this control procedure can of course be influenced by input of suitable data through the input data unit 54.

The control of the dosing units 43–45 can take place in a similar manner and to the extent to which it is possible to sense the parameters of importance to the various dosings. To the extent that such parameter sensing is impossible, this control must be carried out empirically, for example by making laboratory tests of molding-sand samples at some point in the sand circuit form the basis of control data, which again are fed into the input data unit 54. It is obvious, however, that especially the dosing of binder (dosing unit 44) and additives (dosing unit 45) will depend on the amount of molding sand being used for each mold, for which reason the relevant data from the molding station 11 can suitably be used in controlling these dosings.

In accordance with an important embodiment of the invention the parameter recording unit 51 is adapted to transform the recorded parameters into information signal groups, for example, in the form of data records, each of which is associated by the computing unit 52 with the individual molds to which the parameters in question relate, and the control units associated with the work stations of the system are adapted to use the parameter signals contained in the information groups as control signals.

What is claimed is:

1. An automatic foundry plant comprising:

a plurality of work stations, at least one conveyor for conveying molds and cores, and castings produced by a casting process carried out at the foundry plant, between and from said work stations, said work stations comprising a mold production and preparation station and a pouring station in which molten metal is poured into the molds arriving from the mold production and preparation station, and an extraction station in which molds and castings are separated from each other, said extraction station being connected to water dosing units for maintaining the required moisture content of the mold material produced at separation, which material is returned to the mold production and preparation station, and said plant further comprising parameter recording means, associated with at least one of said stations, for recording those parameters with respect to each individual formed mold that relate to at least the moisture content of the material of the formed mold and for producing an output in accordance with the parameters thus recorded, and control means, associated with the water dosing units, for, at least near to the time when the individual mold in question is moved into the extraction station, controlling the water dosing units in dependence upon the parameters related to the moisture content.

2. Foundry plant according to claim 1 wherein the parameter recording means records, for each individual mold, parameters derived from sensing at or downstream from the pouring station a condition of the mold.

3. Foundry plant according to claim 2, wherein said parameters include a signal from the pouring station with information regarding pouring of molten metal into the mold in question.

4. Foundry plant according to claim 1, wherein the parameter recording means records, for reach individual mold, parameters fed thereto as external input data.

5. Foundry plant according to claim 1, wherein a) the parameter recording means transforms the recorded parameters into information signal groups each of which is associated with the mold in question and b) said control means uses the parameters contained in the information signal groups as control signals.

6. Foundry plant according to claim 1 further comprising a treatment station for treating the mold material arriving from the extraction station and connected to a further dosing unit for dosing at least one treatment material, said parameter recording means recording parameters with respect to each individual mold that relate to the addition of said at least one treatment material, and said plant further comprising further control means, connected to said further dosing unit, for, at least near to the time when the mold material produced at the separation of the individual mold in question is moved to the treatment station, controlling said further dosing unit in dependence upon the parameters related to the addition of said at least one treatment material recorded by said, parameter recording means.

7. Foundry plant as claimed in claim 6 wherein said further dosing unit provides dosing of new mold material.

8. Foundry plant as claimed in claim 6 wherein said further dosing unit provides dosing of a binder.

9. Foundry plant as claimed in claim 6 wherein said further dosing unit provides dosing a plurality of additives.

* * * * *